United States Patent [19]

Field, II

[11] 4,173,347

[45] Nov. 6, 1979

[54] GAME BOARD AND PIECES HAVING REMOVABLE INDICIA

[76] Inventor: Ernest R. Field, II, 407 Tulip Ave., Takoma Park, Md. 20012

[21] Appl. No.: 697,342

[22] Filed: Jun. 25, 1976

[51] Int. Cl.[2] ..... A63F 3/02

[52] U.S. Cl. ..... 273/261; 273/282; 273/284; 273/290

[58] Field of Search ..... 273/131, 131 AB, 131 AC, 273/131 B, 131 BA, 131 E, 131 K, 134 AD, 135 AC, 137 AB, 137 AD, 137 F, 242, 260, 282, 284, 290, 261

[56] References Cited

U.S. PATENT DOCUMENTS

| | | | |
|---|---|---|---|
| D. 163,068 | 4/1951 | Robbins, Jr. | 273/134 AD |
| 571,464 | 11/1896 | Truex | 273/131 AB |
| 1,228,091 | 5/1917 | Bradley | 273/131 AB |
| 1,288,924 | 12/1918 | Knoos, Jr. | 273/137 F |
| 1,455,193 | 5/1923 | Duquette | 273/131 AB |
| 2,542,252 | 2/1951 | Ickler | 273/137 F |
| 2,772,885 | 12/1956 | Wales | 273/131 AB |
| 3,649,022 | 3/1972 | Clark, Jr. | 273/134 AD |
| 3,799,549 | 3/1974 | Laker | 273/131 AB |
| 3,810,626 | 5/1974 | Eberle | 273/131 AB |

FOREIGN PATENT DOCUMENTS

| | | | |
|---|---|---|---|
| 561556 | 5/1975 | Switzerland | 273/137 AB |

*Primary Examiner*—Richard C. Pinkham
*Assistant Examiner*—Scott L. Brown

[57] ABSTRACT

A game for two or more players wherein there is a relationship between the playing pieces and the spots and pathways of the playing surface, all of which are made up of an index or an arrangement of indicia, with this said relationship being between the indicia and governed by predetermined rules. On certain of the playing surface spots, there may be placed a plurality of removable and interchangeable elements with each element carrying an indicium different from the other elements. Each playing piece may carry one or more indicium differing from other of the playing pieces and corresponding to an indicium on a removable element. Each playing piece may also removably carry an indicium indicative of ownership by one of the players. The playing pieces are strategically moved from spot to spot, and the game rules may provide for capture of a playing piece by an opponent's piece if it carries an indicium having a higher value in a predetermined hierarchy of indicia.

3 Claims, 8 Drawing Figures

ILLUSTRATIVE EMBODIMENTS

ILLUSTRATIVE EMBODIMENTS

FIG. 5
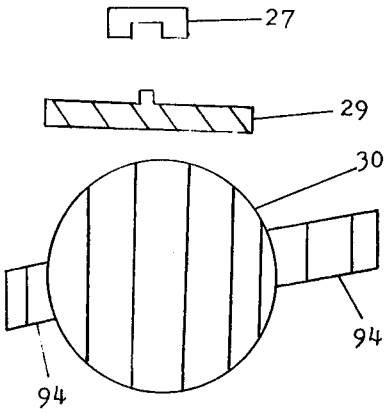
FIG. 6
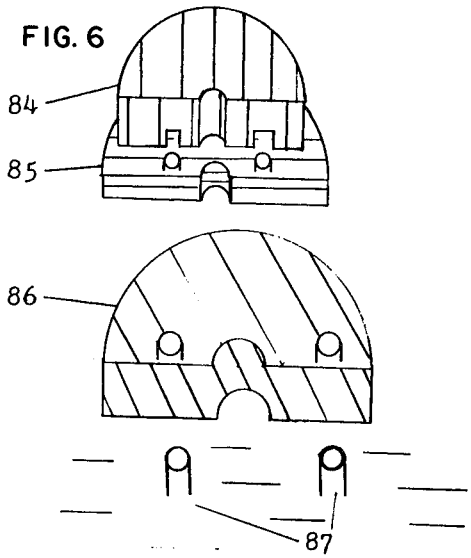
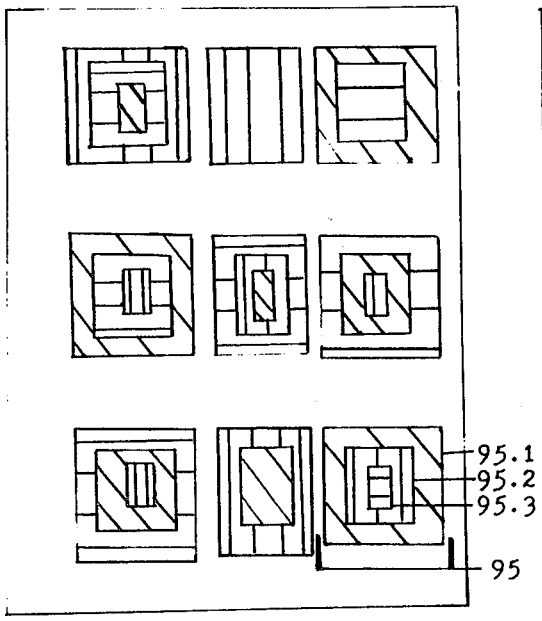
FIG. 7
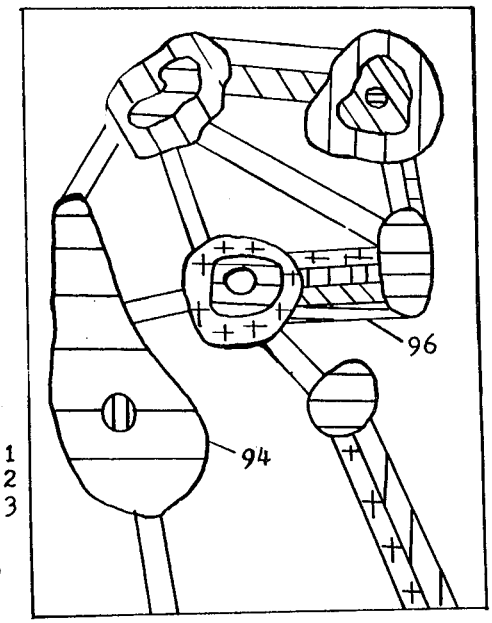
FIG. 8

GAME BOARD AND PIECES HAVING REMOVABLE INDICIA

BACKGROUND AND DESCRIPTION OF ILLUSTRATIVE EMBODIMENTS

This invention can be compared to games of strategy, such as, chess or checkers, where one must play within a contained universe. Its laws are given, and the game proceeds logically without the introduction of chance through dice, spinners, etc. As everyone begins equal, no player has an edge over another except for this innate thinking ability. All game situations are the result of prior moves that could have been anticipated and planned for. The limited future possibilities that are open at any moment during play are totally known. They may be terribly concatenated, but they can still be foreseen, given the requisite amount of concentration and logic.

The advantage of this type of game tactically is obvious. Its appeal lies in the fact that one can formulate strategy and plan for all eventualities. Consequently, I've retained this principle of a predictive, mechanistic structure but added the space-age concept of relativity. I've accomplished this by making the relationship of the playing pieces vis-a-vis each other mutable. Their values aren't frozen, but are fluid. They change relative to each other, as they occupy different spots. Yet these changes are entirely predictable and governed by rules defined from the start of play. This new idea offers more pleasure and amusement; for, besides being in tune with the times, it enlarges the boundaries of the contained universe it is played in by increasing the choices available during play. This avoids the common complaint of boredom and repetition entered against non-chance games, since the greater mobility and variability of the playing pieces rarely allows the same game situation to arise twice in any game.

Figure 1:
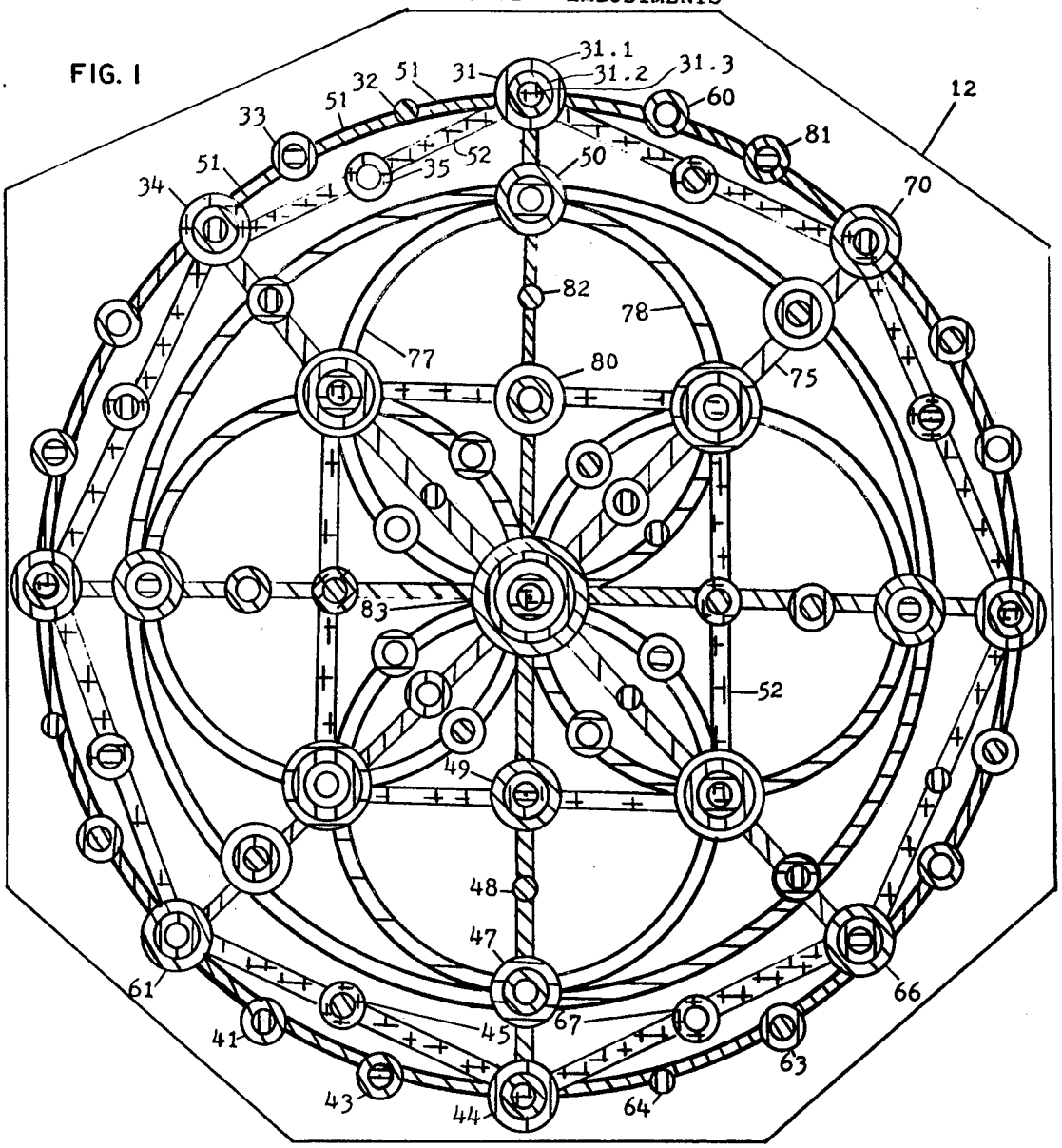
Figure 2:
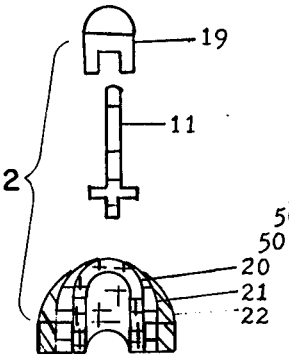
Figure 3:
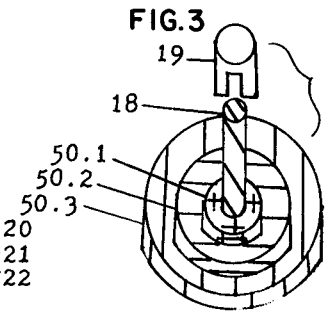

Some illustrative embodiments of this invention are shown in the accompanying drawings in which:

FIG. 1 is a plan view of a playing surface designed in accordance with the claims of this invention, FIGS. 2, 3, and 5 are perspective views of possible playing pieces and spots. As can be seen in these figures the playing piece 11 and the playing piece 18 fit into the holes in the spots. Also there is a hole in the ownership indice 19, so that it can fit on to the playing piece and be changed or removed as needed during the course of play.

Figure 4:
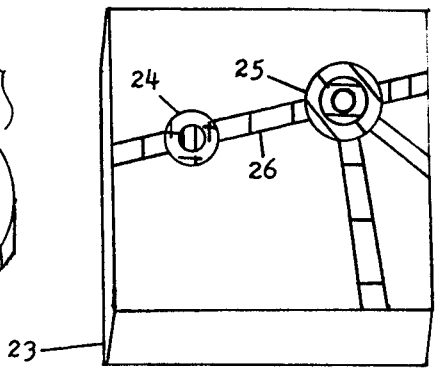

FIGS. 4, 7 and 8 are perspective, sectional views of alternative playing surfaces. As FIG. 4 shows, this surface can be flat, and as FIG. 7 shows, there doesn't necessarily have to be pathways connecting the spots. We can have a playing surface with no pathways. Furthermore, as FIG. 8 shows, the pattern formed by the arrangement of spots on a playing surface need not be geometrical or symmetrical.

FIG. 6 is a sectional view of a possible spot. Note that this allows for changing the arrangement of spots as the pieces fit into each other, thereby allowing other pieces to be inserted in place of them. The playing board would have a number of pegs like 87 over it, so that spots could be put wherever one wished. A playing piece like 11 in FIG. 2 would fit into the holes of 84, 85, and 86.

Looking at FIG. 1, the board 12 has a uniform background, which has delineated throughout it a system of spots (of which 31, 32, and 33 are representative samples). Of course, the arrangement of the system of spots need not be geometrical or symmetrical. It can be of any shape, even asymmetrical, as illustrated by FIG. 8. Looking at spot 31 more closely, one sees that it is divided into three parts: 31.1, 31.2, and 31.3. These three parts are made distinct from each other by means of color, that is, 31.1 is red, 31.2 is green, and 31.3 is yellow. Also, by means of concentric circles they are arranged in a sequence with 31.3 innermost, 31.2 the second innermost, and 31.1 the outermost. Thus, by arbitrarily assigning the innermost color 31.3 the highest value at that spot, we have a value sequence of three colors at spot 31 based upon their arrangement at that spot. Therefore, at spot 31, this priority sequence would be yellow 31.3, green 31.2, red 31.1.

However, color and circular figures are not the only ways of designating an arrangement of values. I chose this method purely for convenience rather than to restrict how it is accomplished. Another method would simply be assigning numbers or symbols of some kind, or using different shapes for different values. The important pcint to be made is that each spot is composed of an indicium or distinguishable indicia, which have an easily recognizable arrangement for assigning values relative to each other. As pointed out, this arrangement may consist of only one indicium, as at spot 32 which is green.

The indices which comprise the spots are selected from a finite indicia group. In FIG. 1, this group contains the five colors red, green, yellow, blue, and white. All spots are made up of one or more of these colors. Many variations of the game are possible by varying the arrangement of colors at a spot, as illustrated by FIG. 6 which shows a mechanism for combining the indicia of a spot differently. Or variations are possible through arranging the system of spots differently than in FIG. 1, as in FIGS. 7 and 8.

Movable playing pieces, as in FIG. 2, occupy the spots. There is only room for one piece at any spot. A playing piece, as piece 11, is made up of an indicium, which in this case is the color blue, selected from the above finite indicia group, and an ownership indice, 19, which here is colored white. As already stated, the finite indicia group in FIG. 1 has five indicia, but this need not always be. There can be constructed variations of the game utilizing indicia groups greater or lesser than five. To determine the value of piece 11 with respect to piece 18, colored green, in FIG. 3, we must consider what spot each piece is occupying. For example, if piece 18 occupied spot 95 in FIG. 7, and it was piece 11 turn to move, and piece 11 was in position to move to spot 95, then piece 11 could capture piece 18 by moving to that spot 95, in which case piece 18 would be either removed from the board or would be transferred to the spot that piece 11 previously occupied plus having its indice of ownership changed to that of piece 11. Whatever procedure would be followed here with regard to a capture maneuver is dependent upon the rules decided upon for play. As to who has the greater value at spot 95, we had already arbitrarily designated the value arrangement there as blue, red, green.

Suppose that after piece 11 captured piece 18 that the opponent of piece 11 had another playing piece colored blue in position to move to spot 95. Then, according to the rules selected, his blue piece could capture piece 11 because blue has the highest value, or under different rules, his blue piece couldn't capture piece 11 and thus not move to spot 95 because blue had the highest value at that spot 95 and so couldn't be captured at that spot. The priority value sequence at spot 95 is blue, red, green, so if a playing piece of color yellow occupied that spot 95, then that yellow piece would be vulnerable to capture by any pieces colored blue, red, or green which could move to that spot 95 on their turn. If, however, a blue, red, or green piece occupied that spot 95, then a yellow piece could not capture any piece there or move to that spot, unless a sacrifice rule was made wherein the yellow piece would exchange spots with the blue, red, or green piece occupying that spot plus changing its ownership indice to the ownership indice of the blue, red, or green piece that was on spot 95. That would be the yellow piece's move, after which it would be the turn of the player whose piece originally occupied spot 95. Note, while certain rules of the game have been given throughout this specification, it should be understood that these are illustrative only and other rules or variations of these rules may be adopted or resorted to.

In regards to rules of movement for the playing pieces, they can be varied. For example, a playing piece in FIG. 7 may move only to an adjacent spot, or may move only diagonally, or may move a number of spots according to the color it is, as red can move two spots in a row or blue three spots in a row, etc. Another variation of this versatile game pertains to the use of pathways as in FIGS. 1 and 8 for determining movement from spot to spot. These pathways are delineated from the board background by colors (or any other suitable indicia, as no limitation should be construed here on how they are delineated so long as their indicia are taken from the same finite indicia group as the indicia for the spots and playing pieces, being red, blue, green, yellow, and white in FIG. 1). Representative examples of pathways include pathway 51 connecting spot 31 and spot 32 or pathway 52 connecting spot 31 and spot 35. The same color pathway may connect more than one spot as the pathway 51 connects spots 31, 32, 33, 34, 60, 81, 70, 50, 82, 80, 83, 49, 48, 47, 44, 43, 41, 61, 64, 63, and 66. Pathways 51, 52, 75, 77, and 78 are examples of each color (indicium) in the color (finite indicia) group used as a pathway. In FIG. 8, we have an example of a pathway composed of more than one indicium. In this case, pathway 96 has four indicia: yellow, red, green, and blue. As to rules of movement along pathways, we may have that a playing piece can move to any spot that is connected by a pathway to his starting spot with one spot along the pathway per turn, or that the playing piece can move as many spots per turn along the pathway as he desires, as long as the indicium of his playing piece is the same as the indicium or indicia of the pathway, and provided that no other playing piece blocks his path along that pathway. Or we may have that a playing piece may move only from spot to spot along a pathway whose indicium corresponds with his playing piece indicium and be barred from moving along pathways whose indicia aren't the same as the indicium of his playing piece.

As to how many playing pieces per person or as to the indicia of the playing pieces, they can be divided up equally or unequally, again depending upon the rules chosen for play. To begin the game, the agreed upon number of playing pieces are placed upon agreed upon spots, whereupon the players move on alternate turns. When a player can't move on his turn or has lost all of his playing pieces, then he has lost and is out of the game. The winner is the last player left. In FIG. 1, as an illustrative example to playing the game, we would decide to locate five playing pieces (red, green, blue, yellow, and white) on the playing surface with the red one placed in spot 34, the green in spot 32, the blue in spot 33, the yellow in spot 31, and the white in spot 35. Our opponent would place his pieces directly opposite us with his red in spot 64, green in spot 63, blue in spot 66, yellow in spot 44, and white in spot 67. By initially giving each player the same kind and number of playing pieces, and by placing these in spots where the color is the same as the color of the highest value of the playing piece, the players can begin the game equally. If one wishes to give an advantage to the other, then these initial conditions can be varied. For example, the playing pieces may be distributed unequally, or the index or arrangement of indicia of a playing piece may be different from player to player. Or the method of placement or the position of placement of the playing pieces prior to the start of play or during play can be varied to give unequal conditions. The players then decide upon who is to go first, and continue according to the rules they have agreed upon.

Any suitable material may be chosen for the playing surface, spots, and playing pieces, such as, wood, plastic, metal, etc.

That which is claimed is:

1. A game apparatus for two or more players comprising:

(a) a playing surface, upon which a plurality of spaced-apart spots are located, which can be occupied by movable playing pieces and by removable indicia elements;

(b) a plurality of indicia elements containing indicia thereon selected from an indicia group, the indicia group containing a plurality of distinctive indicia;

(c) a plurality of movable playing pieces for each player, each playing piece having an indicium thereon selected from said indicia group, there being playing pieces of various indicia; and (d) a plurality of indexes removably attached to the playing pieces, said indexes being indicative of player ownership and said indexes not having indicia thereon selected from said indicia group; whereby the spots are capable of selectively receiving one or more of said indicia elements so that certain of the spots contain one indicium element while the remaining spots contain various pluralities of indicia elements and so that there are different indicia elements at said remaining spots in a specified hierarchy of order.

2. A game as in claim 1, whereby certain of said spots are connected to other of said spots by at least one pathway delineated upon the playing surface, with each pathway made up of at least one indicium selected from the said indicia group.

3. A game as in claim 1, whereby the arrangement of the said indicia elements forming said spots relative to each other on the said playing surface is capable of being changed to a new arrangement by placing said indicia elements in different positions on said playing surface.

* * * * *